US005126624A

United States Patent [19]

Ji

[11] Patent Number: 5,126,624

[45] Date of Patent: Jun. 30, 1992

[54] COLOR CATHODE RAY TUBE HAVING IMPROVED SPRING TYPE CONTACTOR

[75] Inventor: Seong-hun Ji, Pusan, Rep. of Korea

[73] Assignee: Samsung Electron Devices Co., Ltd., Kyunggi-Do, Rep. of Korea

[21] Appl. No.: 577,575

[22] Filed: Sep. 5, 1990

[30] Foreign Application Priority Data

Sep. 5, 1989 [KR] Rep. of Korea ..... 89-13120

[51] Int. Cl.[5] ..... H01J 29/02

[52] U.S. Cl. ..... 313/402; 313/404; 313/407; 313/408

[58] Field of Search ..... 313/402, 404, 405, 406, 313/407, 408

[56] References Cited

U.S. PATENT DOCUMENTS 4,506,188 3/1985 Puhak ..... 313/405

FOREIGN PATENT DOCUMENTS 62-13787 3/1987 Japan .

*Primary Examiner*—Donald J. Yusko
*Assistant Examiner*—Nimeshkumar D. Patel
*Attorney, Agent, or Firm*—Cushman, Darby & Cushman

[57] ABSTRACT

A color cathode ray tube is taught having an improved spring type contactor. The spring type contactor effects electrical connection between a frame and a conductive coating deposited on the inner surface of the funnel, and comprises an 'Ω' shaped fitting portion for being inserted into holes respectively perforated on the shield and the frame to be locked therein, a pair of legs abutting the edge of the hole of the shield, and a 'C' shaped contact portion extended from one of the legs to contact with the conductive coating on the inner surface of the funnel. According to the present invention, the inner magnetic shield is conveniently affixed to the frame, and the electrical resistance between the frame and the conductive coating is diminished so remarkably that the residual electrons in the cathodoluminescent screen and the shadow mask can effectively by-pass to the conductive coating.

3 Claims, 3 Drawing Sheets

COLOR CATHODE RAY TUBE HAVING IMPROVED SPRING TYPE CONTACTOR

FIELD OF THE INVENTION

The present invention relates to a color cathode ray tube having an improved spring type contactor, and more particularly to an improved contactor which is adapted to secure the inner magnetic shield and the frame mounted with a shadow mask of a cathode ray tube.

BACKGROUND OF THE INVENTION

The cathode ray tube, shown in FIG. 1, is an exemplary color cathode ray tube having an envelope of an integration of funnel 10 with a neck 11 and a panel 20 formed with a cathodoluminescent screen 21 on the interior surface thereof, an electron gun 12 provided in the neck 11, a shadow mask 30 located in the interior space of the panel 20 in close adjacency to the screen 21, an inner magnetic shield 32 for enclosing a zone deflected from electron beams emitted from the electron gun 12, and a frame 31 suited for mounting both the shadow mask 30 and the inner magnetic shield 32 thereto, including a hook type spring 35 provided on the side wall thereof to be connected with a stud-like pin 23 partially embedded in the inner surface of the flange 22 of the panel 20.

Through the stud-like pin 22 and a hook type spring 35, the screen 21 is electrically connected with the shadow mask 30, the frame 31, and the inner magnetic shield 32.

A conductive coating 13 is formed on the inner surface of the funnel 10 to electrically contact with an anode button 15. That is, the conductive coating 13 is in electrical contact with both a retainer 14 extended from the electron gun 12 and a spring type contactor 33 secured to the frame 31, so that the anode button 15 provided on the funnel 10 brings electrical contact with them through the conductive coating 13. Thus, the electron gun 12, the cathodoluminescent screen 21, the shadow mask 30, the frame 31, and the inner magnetic shield 32 are electrically connected with the anode button 15.

In this connection, Japanese Patent Publication No. 62-13787 has disclosed technique pertaining to an improved spring type clip suitable for simply securing the inner magnetic shield 32 to the frame 31, and a spring type contactor. And the above-mentioned spring type clip and contactor will be explained below.

The aforesaid inner magnetic shield 32 is attached to the frame 31 by means of a spring type clip 34, and at the same time, as depicted in FIGS. 2 and 3, an elongated plate spring type contactor 33 is also attached to the inner magnetic shield 32. The contactor 33 is formed with a "C" shaped contact portion at one end thereof for contacting with the conductive coating 13 of the funnel 10, and a securing portion with a square hole 333 at the other end thereof.

On the other hand, the spring type clip 34 is bent to form an 'Ω' shaped configuration by using a metal strip, so that the clip 34 includes a triangle type head 341 for being resiliently inserted into the square holes 331, 321 and 333 respectively perforated on the frame 31, the inner magnetic shield 32 and the contactor 33, so that the head 341 is engaged with the edge of the hole 311 of the frame 31, and a pair of legs 342 and 342 abutting the edge of the hole 333 of the contactor 33.

Therefore, since the contactor 33 described above is attached together with the shield 32 to the frame 31, when the cathode ray tube is in operation. it functions as an electrically connecting means through which the residual electrons in the screen 21, the frame 31, and the shield 32 by-pass to a contact terminal of the actuating circuit of the tube by way of the anode button 15.

However, the above-mentioned cathode ray tubes have various designs and configurations of the spring type clips and contactors, so that they should be separately manufactured by different process. Consequently, the conventional cathode ray tubes accompany increase of the cost in both manufacturing the aforesaid two components and controlling the overall inventory of them.

SUMMARY OF THE INVENTION

Therefore, it is an object of the present invention to provide a color cathode ray tube having an improved spring type contactor which is simple in construction and adavantageous in manufacturing cost.

Another object of the present invention is to provide a color cathode ray tube having an improved spring type contactor by which the residual electrons inside the color cathode ray tube can effectively by-pass.

To accomplish the above objects, there is provided, in accordance with the present invention, a color cathode ray tube having an improved spring type contactor, which comprises an envelope of an integration of a funnel with a neck and a. panel formed with a cathodoluminescent screen on the interior surface thereof, an electron gun provided in the neck as a source emitting electron beams, a shadow mask located in the interior space of the panel in close adjacency to the screen, an inner magnetic shield positioned in the interior space of the funnel, a frame suspended within the panel and mounted with the shadow mask and the inner magnetic shield, and a spring type contactor effecting electrical contact between the frame and a conductive coating deposited on the inner surface of the funnel, the spring type contactor comprising an 'Ω' shaped fitting portion for being inserted into holes respectively perforated on the shield and the frame to be locked therein by the edge of the hole of the frame, a pair of legs abutting the edge of the hole of the shield, and a 'C' shaped contact portion extended from one of the legs to contact with the conductive coating on the inner surface of the funnel.

In a preferred embodiment, the contact portion comprises a flat portion formed on a part thereof facing to the inner surface of the funnel for increasing the contact area between the conductive coating and the contact portion.

BRIEF DESCRIPTION OF THE DRAWINGS

The above objects and other advantages of the present invention will become apparent by describing in detail the prefered embodiment of the present invention with reference to the attached drawings in which.

DETAILED DESCRIPTION OF THE PREFERRED EMBODIMENT

Figure 5:
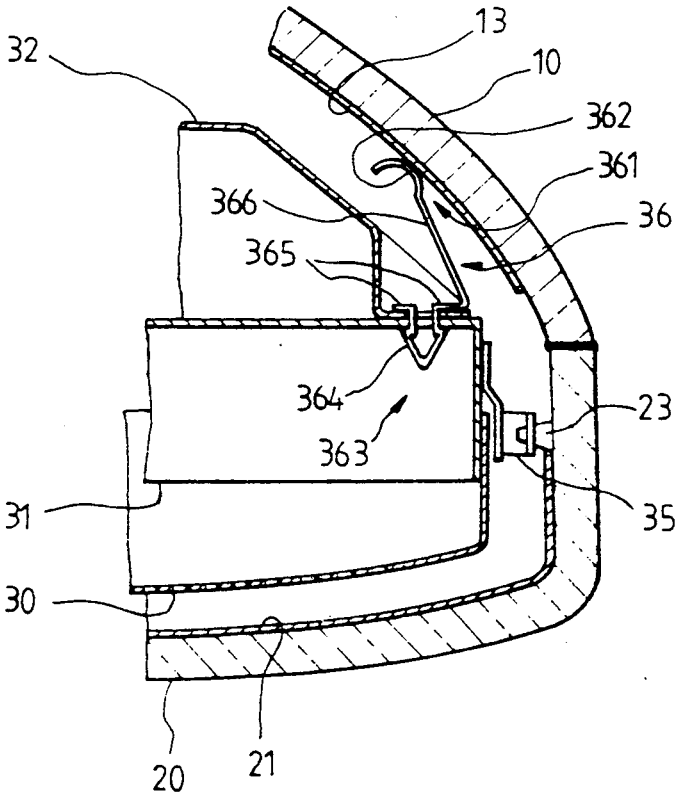
FIG. 5 is an enlarged and sectioned view through a fragment of the color cathode ray tube according to the present invention wherein the inner magnetic shield and the frame are shown as being secured to each other by means of the spring type contactor illustrated in FIG. 4.

A color cathode ray tube according to the present invention comprises basic components required in a typical color cathode ray tube. That is, it has basically an envelope of an integration of a funnel with a neck and a panel provided with a cathodoluminescent screen on the interior surface thereof, and an electron gun provided in the neck. As shown in FIG. 5, in the interior space of the panel 20, there is located a frame 31 to which a shadow mask 30 and an inner magnetic shield 32 are mounted and also there is the frame 31 suspended to the panel 20 by a hook type spring 35 provided on the side wall of the frame 31 and by a stud-like pin 23 partially embedded in the flange 22 of the panel 20, and accordingly the shadow mask 30 faces toward the screen 21, which is electrically connected with the pin 23, so that the screen 21 brings electrical contact with the frame 31 via the pin 23 and the spring 35.

Figure 1:
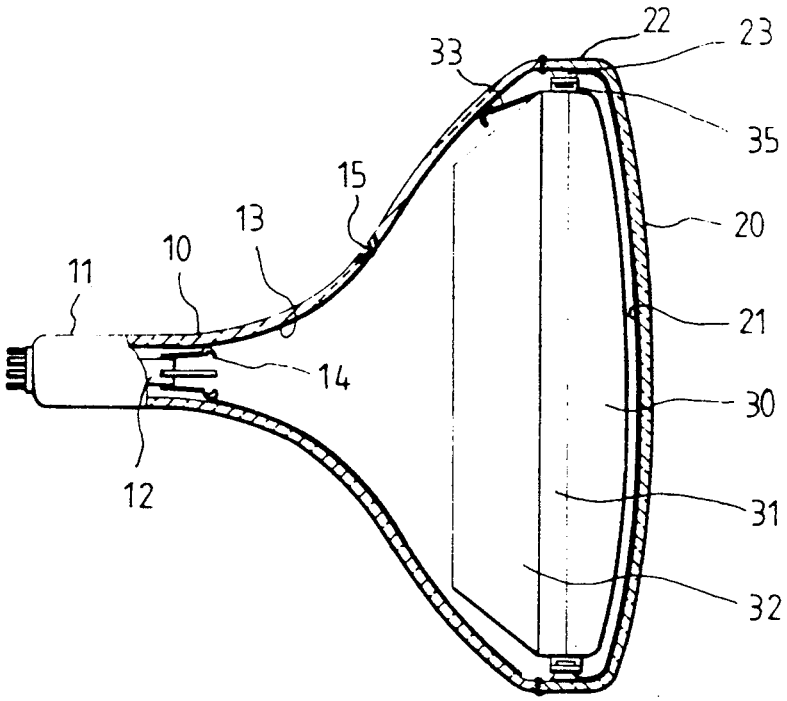
FIG. 1 (Prior Art)
FIG. 1 is a schematic cross-sectioned view of a conventional color cathode ray tube.
Figure 2:
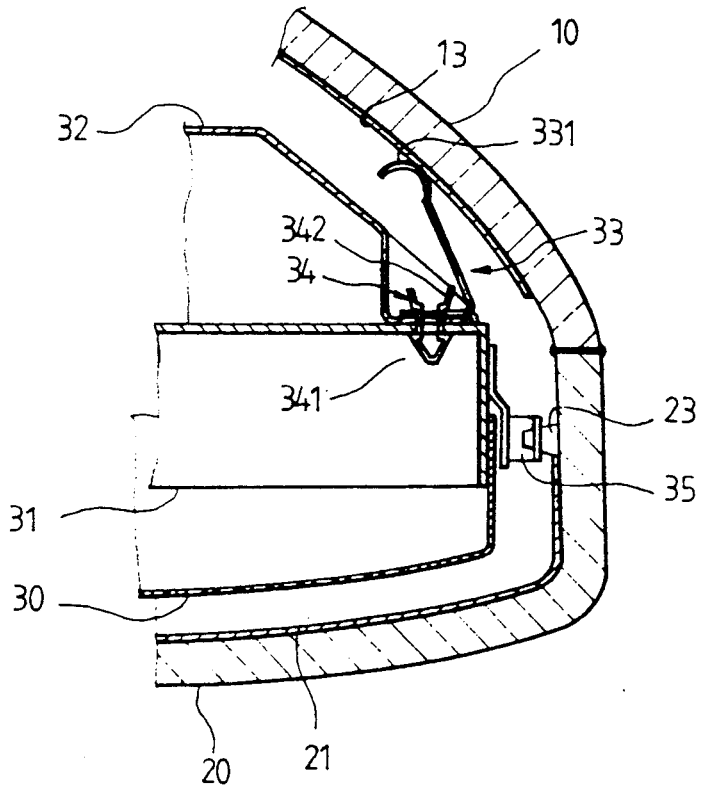
FIG. 2 (Prior Art)
FIG. 2 is an enlarged cross-sectioned view through a fragment of the color cathode ray tube illustrated in FIG. 1.
Figure 3:
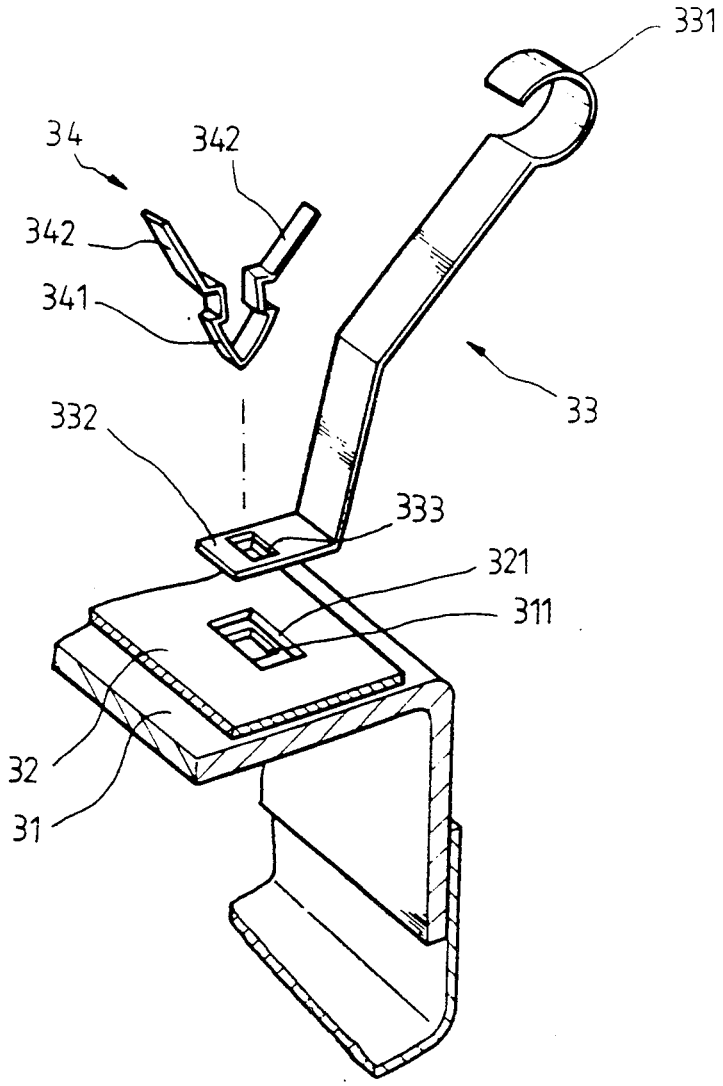
FIG. 3 (Prior Art)
FIG. 3 is an exploded perspective view showing the state of securing a spring type clip and contactor to a frame in the color cathode ray tube illustrated in FIG. 1.
Figure 4:
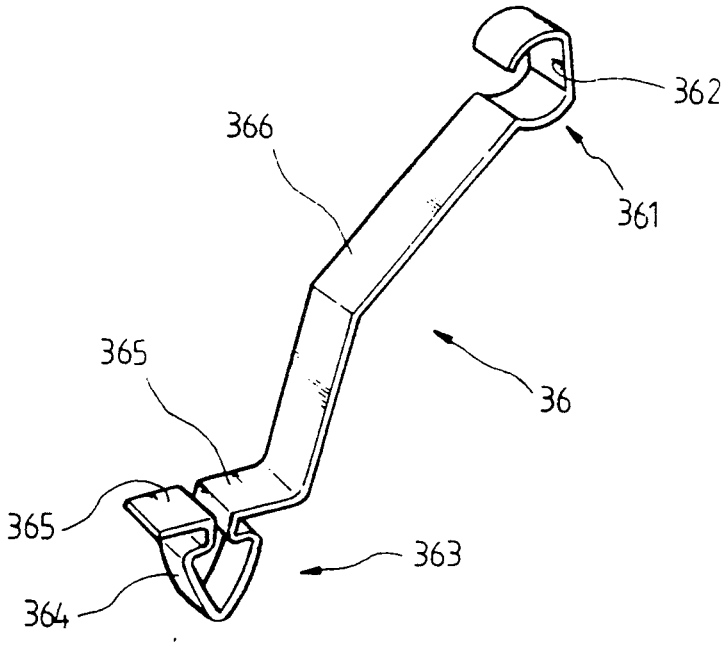
FIG. 4 is a perspective view of an improved spring type contactor employed in a color cathode ray tube according to the present invention.

In addition, a spring type contactor 36 made of a metal strip as an aspect of the present invention is in contact with a conductive coating 13 through a contact portion 361 formed at the upper portion thereof. At the lower portion thereof is formed a fitting portion 363. The spring type contactor 36 shown in FIG. 4 is designed to combine a spring type clip and contactor into a single body. That is, the contactor 36 employed in the color cathode ray tube according to the invention includes an 'Ω' shaped fitting portion 363 for being inserted into holes 321 and 311 respectively perforated on the shield 32 and the frame 31 to be locked therein and a 'c' shaped contact portion 361 to be in contact with the conductive coating 13. And the fitting portion 363 includes a triangle type head 364 suitable to be inserted into the holes 321 and 311 of the shield 32 and the frame 31 to be locked therein by the edge of the hole 311 of the frame 31, and a pair of legs 365 and 365 abutting the edge of the hole 321 of the shield 32.

On the other hand, an extension portion 366 is formed between one of the legs 365 and 365 and the contact portion 361, and also in the middle of the contact portion 361, there is provided a flat portion facing to the inner surface of the funnel 10 so as to contact with the conductive coating 13, thereby increasing the contact area between the conductive coating 13 and the contact portion 361.

In view of the foregoing, since the present invention provides a spring type contactor with an improved construction, the inner magnetic shield can be conveniently affixed to the frame. Moreover, the spring type contactor according to the invention is directly secured to the frame without an additional clip member and at the same time the provision of the flat portion to the contact portion permits the contact area between the two components to increase significantly, thereby decreasing the contact resistance in the contact area.

Accordingly, the electrical resistance between the frame and the conductive coating is diminished so remarkably that, when the cathode ray tube is operated to emit the electron beams from the electron gun, the residual electrons in the cathodoluminescent screen and the shadow mask can effectively by-pass to the conductive coating.

Furthermore, the color cathode ray tube according to the invention is designed to have a spring type contactor in a single body, thereby shortening the manufacturing process and reducing the production cost.

Although the invention has been described in detail with reference to a preferred embodiment, it is intended that the variations and modifications can be carried out while still remaining within the spirit and scope of the invention.

What is claimed is:

1. A color cathode ray tube having an improved spring type contractor, the tube comprising:

an envelope of an integration of a funnel with a neck and a panel formed with a cathodoluminescent screen on the interior surface thereof;

an electron gun provided in said neck as a source for emitting electron beams;

a shadow mask located in an interior space of said panel in close adjacency to said screen;

an inner magnetic shield positioned in an interior space of said funnel;

a frame suspended within said panel and mounted with said shadow mask and said inner magnetic shield; and a spring type contactor effecting electrical contact between said frame and a conductive coating deposited on the inner surface of said funnel, said spring type contactor comprising:

a 'Ω' shaped fitting portion for being inserted into holes respectively perforated on said shield and said frame to be locked therein by the edge of the hole of said frame;

a pair of legs abutting the edge of the hole of said shield; and a 'C' shaped contact portion extended from one of said legs to contact with said conductive coating on the inner surface of said funnel.

2. A color cathode ray tube having an improved spring type contactor as claimed in claim 1, wherein said contact portion includes a flat portion facing the inner surface of said funnel for increasing the contact area between said conductive coating and said contact portion.

3. A color cathode ray tube having an improved spring type contractor, the tube comprising:

an envelope of an integration of a funnel with a neck and a panel formed with a cathodoluminescent screen on the interior surface thereof;

an electron gun provided in said neck as a source for emitting electron beams;

a shadow mask located in an interior space of said panel in close adjacency to said screen;

an inner magnetic shield positioned in an interior space of said funnel;

a frame suspended within said panel and mounted with said shadow mask and said inner magnetic shield; and a spring type contactor effecting electrical contact between said frame and a conductive coating deposited on the inner surface of said funnel, said spring type contactor comprising:

a 'Ω' shaped fitting portion for being inserted into holes respectively perforated on said shield and said frame to be locked therein by the edge of the hole of said frame;

a pair of legs abutting the edge of the hole of said shield; and a 'C' shaped contact portion extended from one of said legs to contact with said conductive coating on the inner surface of said funnel, said contact portion including a flat portion facing the inner surface of said funnel for increasing the contact area between said conductive coating and said contact portion.

* * * * *